US005588529A

United States Patent [19]

Speck

[11] Patent Number: 5,588,529

[45] Date of Patent: Dec. 31, 1996

[54] BASEBALL/SOFTBALL EQUIPMENT BAG

[76] Inventor: Michael W. Speck, 6624 Wanita, Houston, Tex. 77007

[21] Appl. No.: 522,542

[22] Filed: Sep. 1, 1995

Related U.S. Application Data

[63] Continuation of Ser. No. 247,327, May 23, 1994, abandoned.

[51] Int. Cl.[6] ..... B65D 85/20

[52] U.S. Cl. ..... 206/315.1; 190/107; 190/110; 190/111; 190/112; 150/113; 206/579

[58] Field of Search ..... 206/579, 315.9, 206/315.1, 286; 190/9, 102, 103, 107, 109, 110, 111, 112, 113; 150/112, 113, 117

[56] References Cited

U.S. PATENT DOCUMENTS

| | | | |
|---|---|---|---|
| Re. 34,361 | 8/1993 | Pratt | 206/579 |
| 782,047 | 2/1905 | Pearson | 190/112 |
| 1,203,095 | 10/1916 | Bristow . | |
| 2,585,745 | 2/1952 | Crosby | 190/112 X |
| 3,115,959 | 12/1963 | Jaffe | 190/113 X |
| 4,170,282 | 10/1979 | Schwortzstein | 206/287.1 |
| 4,210,186 | 7/1980 | Belenson | 150/52 J |
| 4,301,898 | 11/1981 | Plough et al. | 206/315.1 X |
| 4,378,866 | 4/1983 | Pelavin | 190/52 |
| 4,506,769 | 3/1985 | Franco et al. | 190/108 |
| 4,546,863 | 10/1985 | Kaufman | 190/102 |
| 4,595,226 | 6/1986 | Wessel | 294/146 |
| 4,629,065 | 12/1986 | Braaten | 206/315.1 |
| 4,643,302 | 2/1987 | Baumgardner | 206/315.1 |
| 4,655,343 | 4/1987 | Lone et al. | 206/287.1 |
| 4,657,135 | 4/1987 | Kjose | 206/315.3 |
| 4,693,402 | 9/1987 | Comeau | 224/215 |
| 4,752,008 | 6/1988 | Pratt | 206/579 |
| 4,753,329 | 6/1988 | Choy | 206/315.1 |
| 4,781,277 | 11/1988 | Lim | 190/1 |
| 4,793,532 | 12/1988 | Cash | 224/202 |

(List continued on next page.)

FOREIGN PATENT DOCUMENTS

| | | |
|---|---|---|
| 2653312 | 4/1991 | France . |
| 3934760 | 4/1991 | Germany . |
| 0000635 | 2/1883 | United Kingdom . |
| 9008631 | 8/1990 | WIPO . |

OTHER PUBLICATIONS

Softball Sales, Softball Sales 93, pp. 34–35 (undated).
Softball Sales, Softbal Sales 94, pp. 35–37 (undated).
Louisville Slugger, "Equipment Bags" Product Sheet, 1 page (undated).
Diamond Sports 15th Anniversary, "Bags" Product Sheet, 2 pages (undated).
Steele's, "Equipment Bags" Product Sheet, 1 page (undated).
Star Softballs, "Sports Bags" Product Sheet, 1 page (undated).
Worth, "U–Tote Bags" Product Sheet, 1 page (undated).
Easton, "Bags" Product Sheets, 2 pages (undated).
Rawlings, "Equipment Bags 1994–1995" Product Sheets, 4 pages (undated).
Mizuno, "Bags & Totes" Product Sheets, 3 pages (undated).
Fankit International Inc., "Sportsbag Series and Baseball Equipment Bag Series" Product Sheet, 1 page (undated).
Dudley, "Bags" Product Sheet, 1 page (undated).
Cooper, "Air Locker Bags" Product Sheet, 1 page (undated).

*Primary Examiner*—Paul T. Sewell
*Assistant Examiner*—Tara L. Laster
*Attorney, Agent, or Firm*—Pravel, Hewitt, Kimball & Krieger

[57] ABSTRACT

A baseball equipment bag having an elongated bag portion of flexible material and a substantially planar interior shelf within the elongated bag portion. The interior shelf is permanently secured to the elongated bag portion. A removable panel is capable of being removed to substantially fully expose the interior shelf. The removable panel can be removed from the bag to facilitate the application of commercial printing thereon. The equipment bag includes a bat compartment which allows a bat to be accessed from either of two openings. The equipment bag is capable of collapsing to a substantially flat configuration when not in use.

5 Claims, 2 Drawing Sheets

U.S. PATENT DOCUMENTS

| | | | |
|---|---|---|---|
| 4,805,749 | 2/1989 | Gerch | 190/111 |
| 4,817,802 | 4/1989 | Pratt | 206/579 |
| 4,842,032 | 6/1989 | Mastronardo | 206/309 |
| 4,854,432 | 8/1989 | Carpenter et al. | 190/110 |
| 4,890,731 | 1/1990 | Mroz | 206/315.9 |
| 4,899,887 | 2/1990 | Cachero | 206/579 |
| 4,984,662 | 1/1991 | Jacober | 190/107 |
| 4,995,436 | 2/1991 | Contor | 150/102 |
| 5,042,664 | 8/1991 | Shyr et al. | 206/579 |
| 5,224,602 | 7/1993 | Bettles et al. | 206/579 |
| 5,265,719 | 11/1993 | Wand | 190/112 X |

FIG. 4
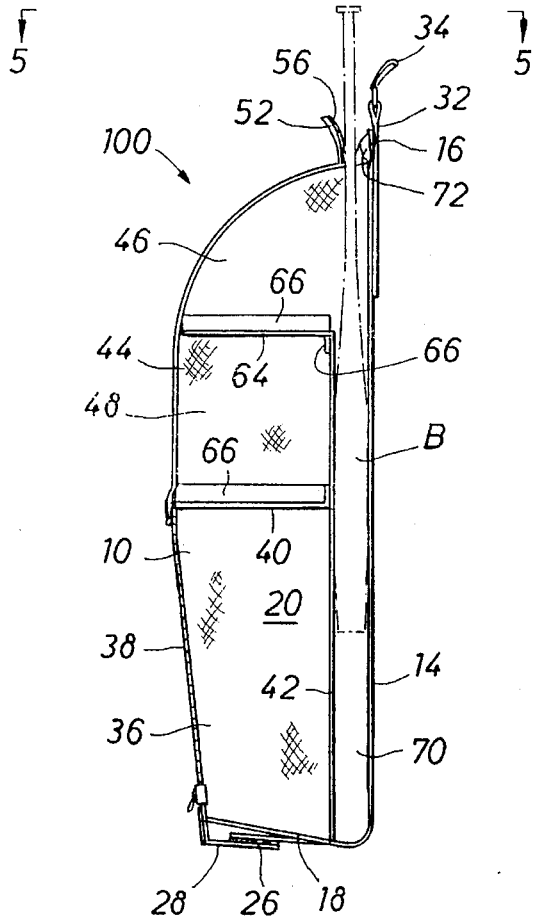
FIG. 6
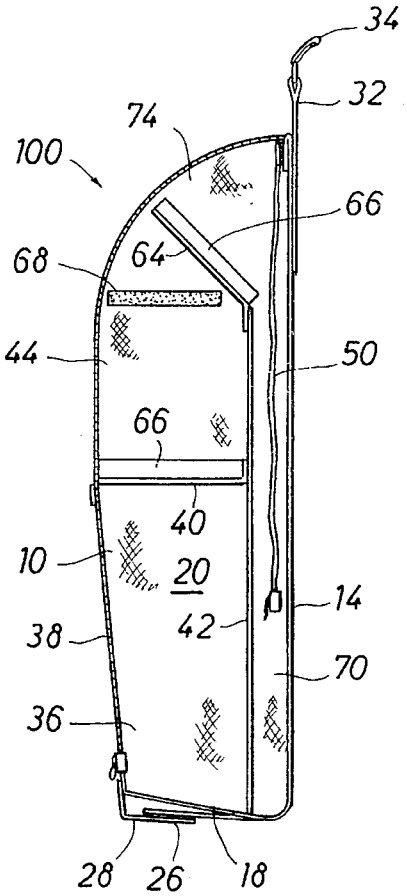
FIG. 5
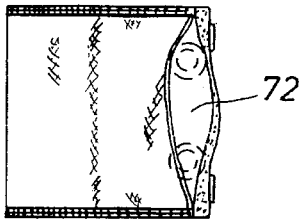
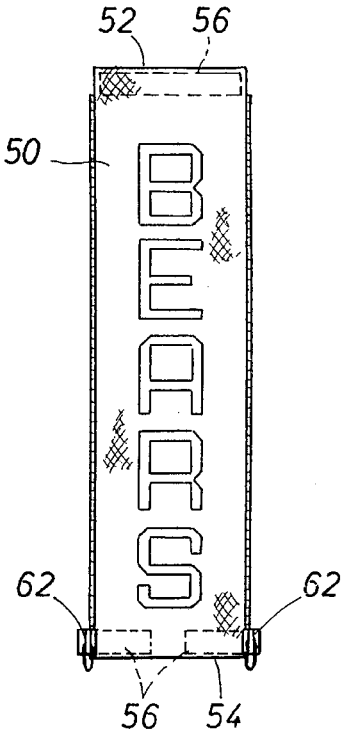
FIG. 7

BASEBALL/SOFTBALL EQUIPMENT BAG

This is a continuation of application Ser. No. 08/247,327 filed on May 23, 1994 now abandoned.

BACKGROUND OF THE INVENTION

1. Field of the Invention

The present invention relates to baseball/softball equipment bags, and more particularly to bags adapted to hang from a fence.

2. Description of the Prior Art

Due to the ever popular sports of baseball and softball, a variety of equipment bags have been made and marketed to store, carry and transport an individual player's baseball or softball equipment to and from a player's house to the playing field.

Baseball equipment bags have become more sophisticated with time. The early prior art bags were typically an elongated duffel or roll-type bag having a zippered opening and an elongated storage compartment for storing the player's equipment. This type of bag is popular because of its soft-sided feature which makes it easy to store and transport. The player's equipment typically includes at a minimum a bat, a ball glove, one or more balls, a cap, and playing shoes. Many players will also carry additional equipment, as for example a batting glove, glasses, a scorebook or pine tar, to name but a few. Additionally, it may be desirable to carry the player's shirt, pants and a towel in the bag for convenience. Thus, a variety of items may typically be carried in the player's bag. The plain elongated duffel or roll-type bag with one elongated compartment fails to keep the various items in any semblance of organization in the equipment bag making it difficult for the player to keep items segregated and inconvenient for the player to find things within the bag.

The problems associated with segregating the items and finding things within the bag have been partially resolved by including pouches and/or pockets attached to the inside and/or outside of the bag. Typically, the pouches or pockets have an opening which closes by means of a zipper, elastic or VELCRO hook and loop fasteners. VELCRO is a registered trademark of Velcro Industries B.V. The present baseball equipment bags typically include a segregated and separate bat compartment for housing one or more bats with access to the bats being provided solely by means of a zippered bat opening. Additionally, the present bags typically include a clip at one end of the elongated bag for hanging the bag from a chain link fence. The hanging feature allows the player to store the bag off of the dirt or ground during the ball game.

While the present baseball equipment bags do provide segregation and more convenience than the early single compartment duffel bags, it is desirable to have a baseball equipment bag having interior shelves to provide quick and convenient access to stored items when the bag is hanging vertically from a chain link fence. It is further desirable that the baseball equipment bag be flexible to provide convenient storage or transport of the bag. It is also desirable that the baseball equipment bag have a removable panel to provide substantial exposure of the shelves when hanging from a fence. It is further desirable to have a removable panel which can be removed from the bag to facilitate the application of commercial printing thereon. It is also desirable to have a bat compartment which allows the bat or bats to be accessed from either of two openings.

SUMMARY OF THE PRESENT INVENTION

The baseball equipment bag of the present invention has interior shelves to provide quick and convenient access to stored items when the bag is hanging vertically from a chain link fence. The baseball equipment bag is flexible to provide convenient storage or transport of the bag. The baseball equipment bag has a removable panel to provide substantial exposure of the shelves when hanging from a fence. The removable panel can be removed from the bag to facilitate the application of commercial printing thereon. The bag further includes a bat compartment which allows a bat or bats to be accessed from either of two openings.

BRIEF DESCRIPTION OF THE DRAWINGS

In order to more fully understand the drawings referred to in the detailed description of the present invention, a brief description of each drawing is presented, in which:

FIG. 4 is a sectional view similar to FIG. 3 showing in dashed lines a bat being inserted into or removed from the equipment bag through an upper opening with the removable panel in place on the equipment bag;

FIG. 5 is a top view taken along line 5—5 of FIG. 4;

FIG. 6 is a sectional view similar to FIGS. 3 and 4 showing the pivotal movement of the second shelf and the removable panel stored in the bat compartment; and FIG. 7 is a plan view of the removable panel showing a team name printed thereon.

DETAILED DESCRIPTION OF THE INVENTION

Figure 1:
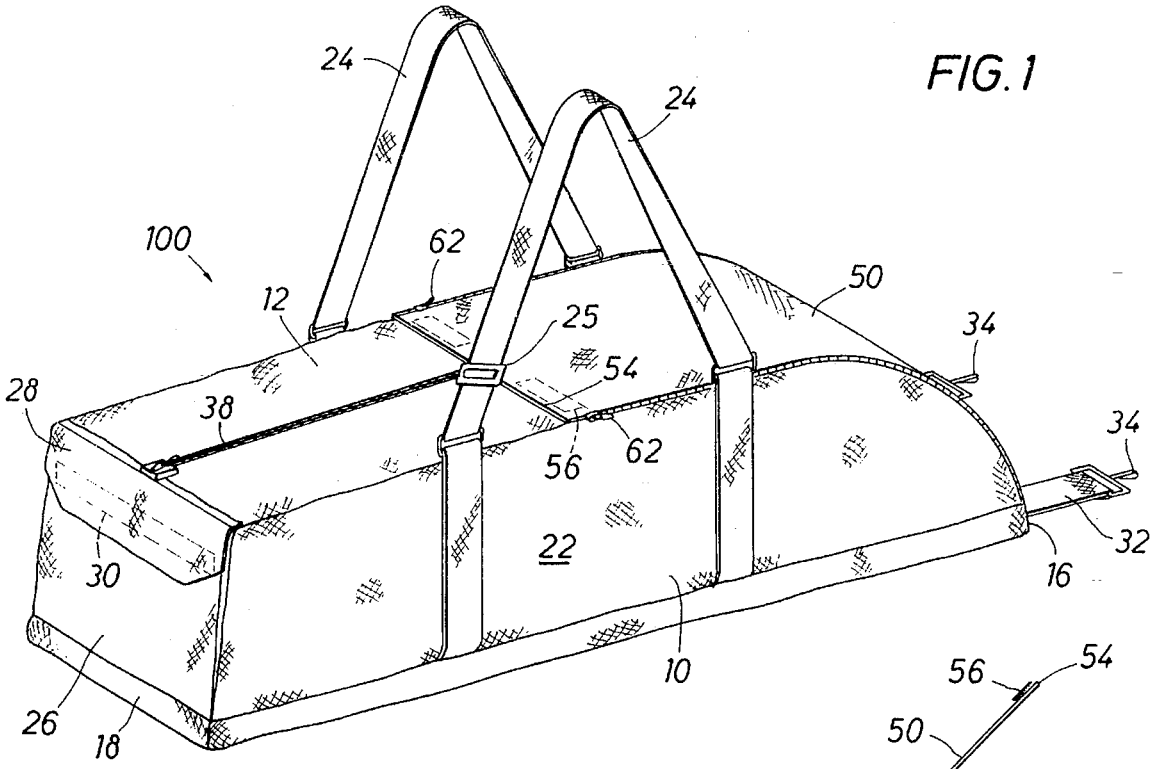
FIG. 1 is a perspective view of the preferred embodiment of the baseball/softball equipment bag according to the present invention.

Referring now to the drawings in greater detail, the baseball/softball equipment bag, generally designated by the letter B, includes an elongated bag portion 10 having a front 12, a back 14, a top end 16, a bottom end 18, and left and right sides 20 and 22, respectively.

Preferably, the baseball equipment bag 100 has a length of approximately 36 inches to accomodate baseball or softball bats B which are typically less than 36 inches long. In the preferred embodiment, the elongated bag portion 10 is lightweight and made out of a flexible fabric such as nylon.

Referring to FIG. 1, the equipment bag 100 includes a pair of straps 24 attached to the sides 20 and 22 of the bag 100. The straps 24 are capable of extending beyond the front 12 of the bag 100 and provide a means for carrying the equipment bag 100. Preferably, the straps 24 are flexible and made of nylon. As shown in FIG. 1, preferably the straps 24 include a buckle means 25 for adjusting the length of the strap 24 for the convenience of the ball player.

Referring to FIGS. 1–4 and 6, an exterior pocket 26 is formed on the bottom end 18 of the bag 100. The exterior pocket 26 includes an outer flap 28 which extends down over the opening of the exterior pocket 26. In the preferred embodiment, the outer flap 28 closes the exterior pocket 26 by means of hook and loop type fasteners 30 such as VELCRO fasteners. VELCRO is a registered trademark of Velcro Industries B.V. It is to be understood that the exterior pocket could be closed with other closure means, as for example a zipper. It is additionally to be understood that one or more exterior pockets may be attached to the equipment bag 100.

Figure 2:
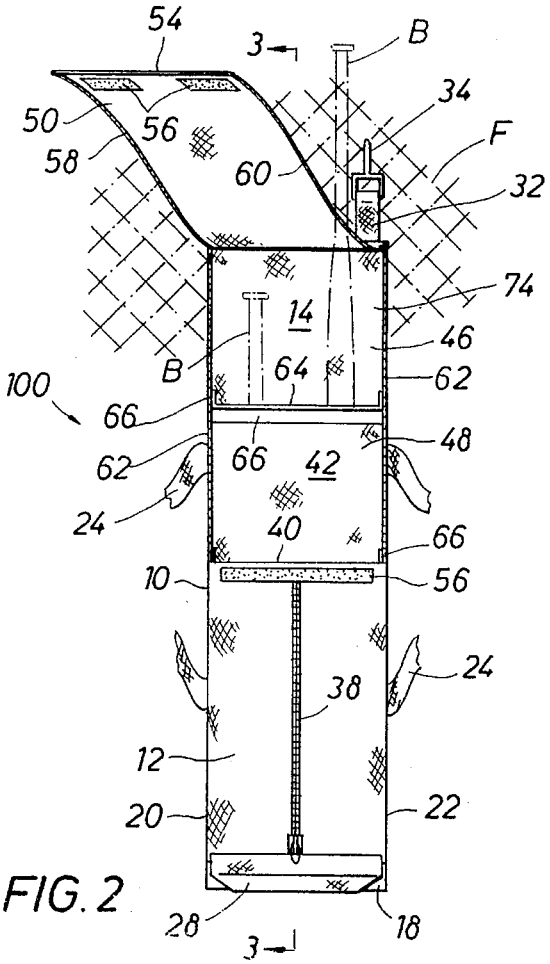
FIG. 2 is a front elevation view of the baseball/softball equipment bag hanging from a chain link fence, the dashed lines showing two bats with the right bat being inserted into or removed from the equipment bag with the removable panel partially unzipped from the equipment bag.

Referring to FIGS. 1–4 and 6, the equipment bag 100 includes one or more hanging straps 32 attached to the back 14 of the bag 100 at the top end 16. In the preferred embodiment, a pair of hanging straps 32 are attached to the bag 100. A clip or hook 34 is attached to the end of each hanging strap 32. Referring to FIG. 2, the clip 34 is adapted to clip onto a fence F, such as a chain link fence, to vertically hang the bag 100.

Referring to FIGS. 1–4 and 6, the equipment bag 100 includes a lower interior compartment 36 having a zippered opening 38. In the preferred embodiment, the lower interior compartment 36 is formed by the left side 20, right side 22, front 12, bottom end 18, a first shelf 40 and a rear panel 42.

In the preferred embodiment, the first shelf 40 is substantially planar and rigid. Preferably, the first shelf 40 is permanently secured to the bag 100, as for example by sewing. The perimeter of the first shelf 40 is fully sewn to the left and right sides 20 and 22, respectively, the rear panel 42 and the front 12. The zippered opening 38 of the lower interior compartment 36 extends substantially the length of the lower interior compartment 36, i.e. from approximately the first shelf 40 to the bottom end 18.

Figure 3:
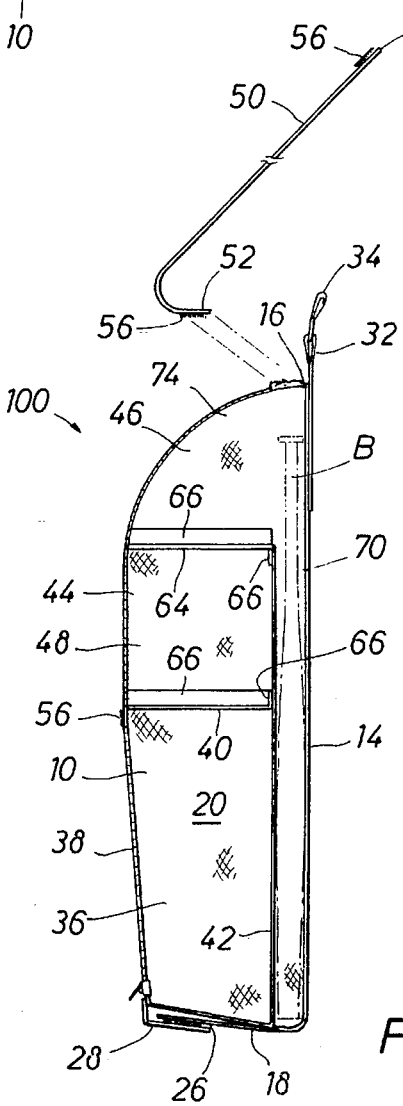
FIG. 3 is a sectional view taken along line 3—3 of FIG. 2.

Referring to FIGS. 2–4, an upper portion 44 of the bag 100 is divided into a top compartment 46 and an intermediate compartment 48. In the preferred embodiment, the bag 100 includes a second shelf 64 which is permanently secured to the rear panel 42 and also secured to the left and right sides 20 and 22, respectively, of the bag 100. It may be desirable to attach the second shelf 64 to the sides 20 and 22 with VELCRO hook and loop type fasteners 68 as shown in FIG. 6. The VELCRO fasteners 66 permit the second shelf 64 to be pivoted upwardly or downwardly about the rear panel 42 if desired to form a single upper compartment rather than top and intermediate compartments 46 and 48, respectively. Preferably, the second shelf 64 is substantially planar and rigid.

It is to be understood that the first and second shelves 40 and 64, respectively, are preferably covered with a fabric and include generally peripheral lips 66 which are either upturned or downturned as shown in FIGS. 2–4 and 6. The lips 66 are fabric and permit stitching of the lips 66 to the fabric sides 20 and 22, rear panel 42 or front 12.

In the preferred embodiment, the rear panel 42 is flexible and preferably made of fabric. As shown in FIGS. 3, 4 and 6, the rear panel 42 is generally parallel to the back 14 and extends continuously from the second shelf 64 to the bottom end 18. Referring to FIG. 2, the rear panel 42 extends across the bag 100 from the left side 20 to the right side 22.

It is to be understood that the preferred embodiment of the present invention does not include any rigid framing or supports for the first and second shelves 40 and 64, respectively. In the preferred embodiment, the first and second shelves 40 and 64, respectively, are substantially planar and rigid although it may be desirable to make one or both of the shelves non-planar or non-rigid. The equipment bag 100 is capable of collapsing to a substantially flat configuration about the planar, rigid shelves 40 and 64 when not in use.

Referring to FIGS. 1–3, a removable panel 50 is removably secured to the elongated bag portion 10. In the preferred embodiment, the removable panel 50 includes VELCRO hook and loop type fasteners 56 at the upper and lower edges 52 and 54, respectively, of the removable panel 50. Mating VELCRO hook and loop type fasteners 56 are attached to the top end 16 and at the exterior surface of the bag 100 proximate to the first shelf 40. The left and right edges 58 and 60, respectively, of the removable panel 50 are preferably attached to the elongated bag portion 10 by zippers 62.

In FIG. 1, the removable panel 50 is shown fully secured to the bag 100 to secure and conceal the contents in the top and intermediate compartments 46 and 48, respectively. FIG. 1 shows the typical configuration of the equipment bag 100 in a horizontal position during transport or storage. Referring to FIG. 2, the pair of edge zippers 62 have been unzipped and the VELCRO fasteners 56 along the lower edge 54 of the removable panel 50 have been unfastened. As shown in FIG. 3, the removable panel 50 is entirely removed by unfastening the VELCRO fasteners 56 along the upper edge 52 of the removable panel 50.

As shown in FIGS. 2 and 3, the removable panel 50 can be positioned so as to substantially fully expose the first and second shelves 40 and 64, respectively. As shown in the FIG. 6, the removable panel 50 can be taken from the position as shown in FIG. 2 and forcibly inserted between the rear panel 42 and the back 14 if desired.

Referring to FIG. 7, the removable panel 50 can be fully removed from the bag 100. The removed panel 50 will lie flatly upon a flat, planar surface. This greatly facilitates the application of printing by standard commercial printing techniques to the panel 50 by such printing techniques as screen printing. As shown in FIG. 7, team names or logos or the player's name can easily be printed on the removable panel 50 of the equipment bag 100.

Referring to FIGS. 3, 4 and 6, a bat compartment 70 is formed between the rear panel 42 and the back 14. The bat compartment 70 extends along the entire length of the bag 100. As shown in FIG. 3, the bat or bats B will rest against the bottom end 18 when the equipment bag 100 is hanging upright against a fence F. The upper end of the bat B will extend above the second shelf 64 as shown in FIGS. 2 and 3.

In use, the bats B are stored in the bag 100 with the bat handle up and the barrel down as shown in FIGS. 2–4, or in the inverted position, if desired.

The bats B can be inserted into or removed from the bat compartment 70 of the equipment bag 100 in at least two ways. Referring to FIGS. 4 and 5, the bat B can be inserted into or removed from the bag 100 in any bag position by unfastening the VELCRO fasteners 56 at the upper edge 52 of the removable panel 50 and the top end 16 of the bag 100 to form a bat opening 72 large enough to reach in and grab the upper end of the bat B and pull the bat B out. In addition, the bat opening 72 is large enough to insert the lower end of the bat B through the bat opening 72 and direct the bat B into the bat compartment 70.

Alternatively, the zippers 62 can be unzipped along the left and right edges 58 and 60, respectively, of the removable panel 50 and the lower VELCRO fasteners 56 unfastened to allow access to the upper portion of the bats B. The bats B can be inserted into or removed from the bag 100 by accessing the bats B from the front opening 74 of the top compartment 46. It is to be understood that the bats B can also be accessed with the removable panel removed from the bag 100 (FIG. 3) or inserted in the bat compartment 70 (FIG. 6).

The equipment bag 100 of the present invention uniquely provides a usable and functional equipment bag 100 which is designed to be used during a ballgame in addition to transporting equipment to and from the ballpark. The hanging equipment bag 100 of the present invention serves as a locker for the player during, prior to and after the ballgame. For example, typically the removable panel 50 is removed or tucked into the bat compartment 70 during the ballgame. The first and second shelves 40 and 64, respectively, are fully accessible from the front of the equipment bag 100. The shelves 40 and 64 can be utilized to store the player's ball glove, cap, glasses, or other accessories when not being used by the player during the ballgame.

The foregoing disclosure and description of the invention is illustrative and explanatory thereof, and various changes in the size, shape, and materials, as well as in the details of illustrative construction and assembly, may be made without departing from the spirit of the invention.

I claim:

1. A hanging baseball equipment bag comprising:

a flexible, elongated bag having a length, a top end and a bottom end, a front, a back, a left side and a right side, said elongated bag being non-rigid in a direction between said top and bottom ends;

fence clips for vertically hanging said elongated bag from a chain link fence;

a substantially planar and rigid interior shelf substantially medially positioned between said top and bottom ends within said flexible, elongated bag, said interior shelf is substantially horizontal when said flexible, elongated bag vertically hangs from said fence clips in a substantially vertical position;

a flexible interior rear panel attached to the interior of said flexible, elongated bag and oriented substantially parallel to said back, said interior rear panel dividing said flexible, elongated bag into a front compartment extending substantially the length of said elongated bag and a rear compartment extending substantially the length of said elongated bag, said front compartment divided into an upper front compartment and a lower front compartment by said interior shelf, wherein said front compartment is located between said front and said interior rear panel and said rear compartment is located between said back and said interior rear panel; and means for accessing said front compartment and said rear compartment in said front and said top end.

2. The equipment bag of claim 1, wherein said means for accessing comprises:

an outer panel attached to said elongated bag with a first attachment means and a second attachment means, said first and second attachment means being independent of one another, said first attachment means providing access to said rear compartment and said second attachment means providing access to said front compartment.

3. The equipment bag of claim 1, wherein said means for accessing comprises:

an outer panel formed in said front and top end so as to substantially fully expose and provide access to said upper front compartment from the front and from the top of said elongated bag.

4. The equipment bag of claim 2, wherein said outer panel is formed in said front and top end so as to substantially fully expose and provide access to said upper front compartment from the front and from the top end of said elongated bag.

5. The equipment bag of claim 1, wherein said means for accessing comprises an outer panel, said outer panel has a closed position and an open position, in said closed position said outer panel closes said upper front compartment, in said open position said upper front compartment is exposed and said outer panel is stored between said back and said flexible interior rear panel.

* * * * *